US009365269B2

(12) United States Patent
Kazazian et al.

(10) Patent No.: US 9,365,269 B2
(45) Date of Patent: Jun. 14, 2016

(54) PERSONAL FLOTATION DEVICE

(71) Applicant: Exxel Outdoors, Inc., City of Industry, CA (US)

(72) Inventors: Harry A. Kazazian, Glendale, CA (US); M. Susan Balistreri, Wesley Chapel, FL (US)

(73) Assignee: Exxel Outdoors, Inc., City of Industry, CA (US)

( * ) Notice: Subject to any disclaimer, the term of this patent is extended or adjusted under 35 U.S.C. 154(b) by 21 days.

(21) Appl. No.: 14/477,599

(22) Filed: Sep. 4, 2014

(65) Prior Publication Data

US 2015/0064999 A1 Mar. 5, 2015

Related U.S. Application Data

(60) Provisional application No. 61/873,774, filed on Sep. 4, 2013.

(51) Int. Cl.

| | |
|---|---|
| ***B63C 9/08*** | (2006.01) |
| ***B63C 9/115*** | (2006.01) |
| ***B63C 9/135*** | (2006.01) |
| *A63B 31/00* | (2006.01) |

(52) U.S. Cl.

CPC ..... *B63C 9/115* (2013.01); *B63C 9/135* (2013.01); *A63B 31/00* (2013.01); *A63B 2208/12* (2013.01)

(58) Field of Classification Search

CPC ..... B63C 9/08; B63C 9/087; B63C 9/11; B63C 9/115; B63C 9/13; B63C 9/135; A63B 31/00; A63B 2208/12

USPC ..... 441/80, 88, 106–108, 113–119, 122

See application file for complete search history.

(56) References Cited

U.S. PATENT DOCUMENTS

| | | | | |
|---|---|---|---|---|
| 252,828 | A | 1/1882 | Williams | |
| 3,570,030 | A | 3/1971 | Baker | |
| 4,397,636 | A | 8/1983 | Ganshaw | |
| 4,799,908 | A | 1/1989 | Lucius | |
| 5,013,271 | A * | 5/1991 | Bartlett | A41D 13/0125 441/102 |
| 5,759,076 | A | 6/1998 | Bateman et al. | |
| 6,066,017 | A | 5/2000 | Max et al. | |
| 6,582,266 | B1 | 6/2003 | Steger et al. | |
| 6,659,689 | B1 * | 12/2003 | Courtney | B63C 9/08 2/2.17 |
| 6,805,519 | B1 * | 10/2004 | Courtney | B63C 9/08 405/185 |

(Continued)

FOREIGN PATENT DOCUMENTS

| | | | |
|---|---|---|---|
| JP | H07252706 | A | 3/1995 |
| WO | 2012141578 | A2 | 10/2012 |

*Primary Examiner* — Daniel V Venne

(74) *Attorney, Agent, or Firm* — Sheppard, Mullin, Richter & Hampton LLP

(57) ABSTRACT

An improved personal flotation device is disclosed. The personal flotation device comprises a shirt with sleeves, a torso flotation pad attached to the shirt and positioned around a user's torso, and two flotation sleeves attached to the shirt's sleeves on a user's arms. The torso flotation pad comprises a front flotation pad which is raised above the midriff area of the user and two graduated side pads which are wrapped around a user's torso. The raised position of the front flotation pad keeps a user's center of buoyancy above the user's center of gravity, raising the user higher up out of the water and preventing the user from flipping over into the water. The flotation sleeves are positioned high on a user's arms to further increase a user's freeboard while permitting freedom of movement.

20 Claims, 3 Drawing Sheets

(56) References Cited

U.S. PATENT DOCUMENTS

| | | | | |
|---|---|---|---|---|
| 7,255,621 | B2 | 8/2007 | Deslauriers | |
| 8,591,275 | B2 | 11/2013 | Gonsalves et al. | |
| 2005/0221699 | A1 | 10/2005 | Kaplan | |
| 2006/0094316 | A1 | 5/2006 | Gilmer | |
| 2008/0160849 | A1 | 7/2008 | Steger | |
| 2008/0254694 | A1 | 10/2008 | Spinoza | |
| 2011/0009020 | A1* | 1/2011 | Withers | B63C 9/125 441/118 |
| 2012/0149261 | A1* | 6/2012 | Gonsalves | B63C 9/115 441/115 |

* cited by examiner

PERSONAL FLOTATION DEVICE

CROSS-REFERENCE TO RELATED APPLICATION

This application claims the benefit of U.S. Provisional Application Ser. No. 61/873,774, filed on Sep. 4, 2013, the entire contents of which are incorporated by reference as if fully set forth herein.

BACKGROUND OF THE INVENTION

The present invention relates generally to personal flotation devices, and more particularly to wearable personal flotation devices. Personal flotation devices are commonly used to keep children or novice swimmers safe in the water by keeping the user afloat. Personal flotation devices are generally worn on the body, and add buoyancy to keep a user above water. However, problems can occur where the buoyancy provided by the personal flotation device may cause the user to be unbalanced and uncomfortable in the water. Where a user's center of gravity and center of buoyancy are greatly misaligned, a personal flotation device may even cause a user to flip over into the water and make it difficult for the user to get back upright, endangering the user. It can readily be appreciated that there is a need for a personal flotation device that keeps a user safe and upright in the water while still allowing for a comfortable range of movement. The present invention fulfills these needs and provides further related advantages.

SUMMARY OF THE INVENTION

The present invention may be embodied in a personal flotation device comprising a shirt having two sleeves; a front flotation pad attached to the shirt and positioned on a user's torso; and two flotation sleeves, each flotation sleeve attached to one of the shirt's two sleeves. The front flotation pad is positioned above the user's midriff (waist or stomach) such that the user's center of buoyancy is positioned at or above the user's center of gravity.

In one aspect of this embodiment, the front flotation pad may comprise a buoyant foam encased in a water-resistant fabric. Similarly, the two flotation sleeves may each comprise a buoyant foam encased in a water-resistant fabric.

The shirt may comprise a stretch fabric, such as spandex or the synthetic fiber sold under the trademark Lycra.

In a preferred embodiment, the two flotation sleeves may be positioned on a user's upper arm. In a more specific aspect, the shirt may comprise two armholes where the two sleeves are attached to the shirt, and the distance from each armhole to the flotation sleeve may be approximate 0.5-2.0 inches. The distance from a top edge of the front flotation pad to the armhole may be approximately 2-6 inches.

In another aspect, the shirt may further comprise a securing means positioned on a back side of the shirt to secure the shirt around a user. The securing means may comprise any appropriate means, some known examples of which include a zipper, buckle, hook-and-loop fastener (e.g., Velcro), buttons, laces, hooks, magnets, and the like.

The personal flotation device may further comprise two side pads attached to opposite ends of the front flotation pad to wrap around a user's torso.

The present invention may also be embodied in a personal flotation device comprising a shirt having two sleeves, the shirt comprising a stretchable, water-resistant fabric; a front flotation pad attached to the shirt and positioned on a user's torso; two side flotation pads positioned on opposite sides of the front flotation pad and configured to be wrapped around a user's torso; and two flotation sleeves, each flotation sleeve attached to one of the shirt's two sleeves and positioned on the user's upper arms. The front flotation pad is positioned such that the user's center of buoyancy is positioned at or above the user's center of gravity.

BRIEF DESCRIPTION OF THE DRAWINGS

Embodiments of the present disclosure will now be described, by way of example only, with reference to the following drawings.

DESCRIPTION OF THE INVENTION

Figure 1:
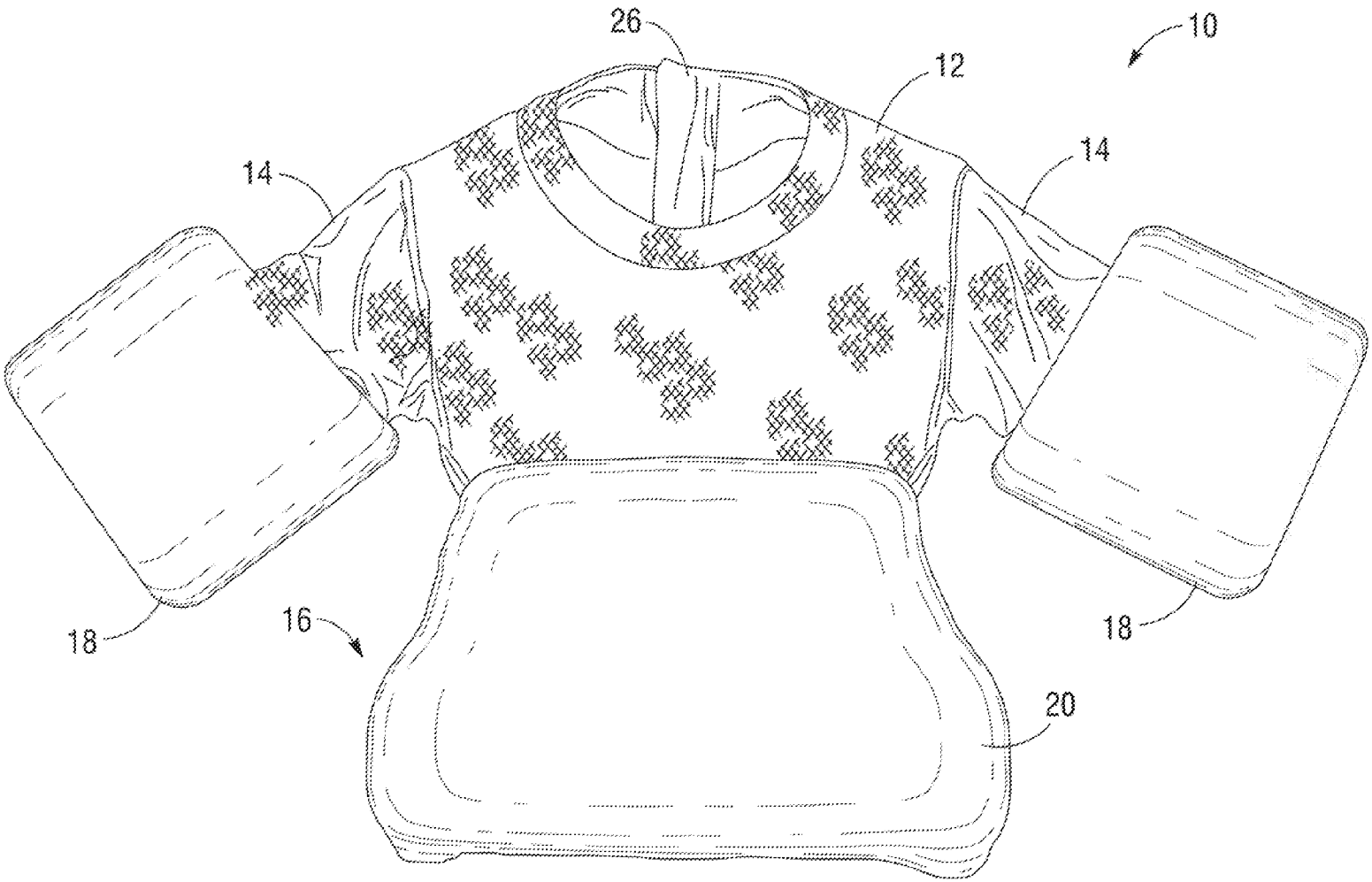
FIG. 1 provides a front elevational view of a personal flotation device in accordance with an embodiment of the present invention.
Figure 2:
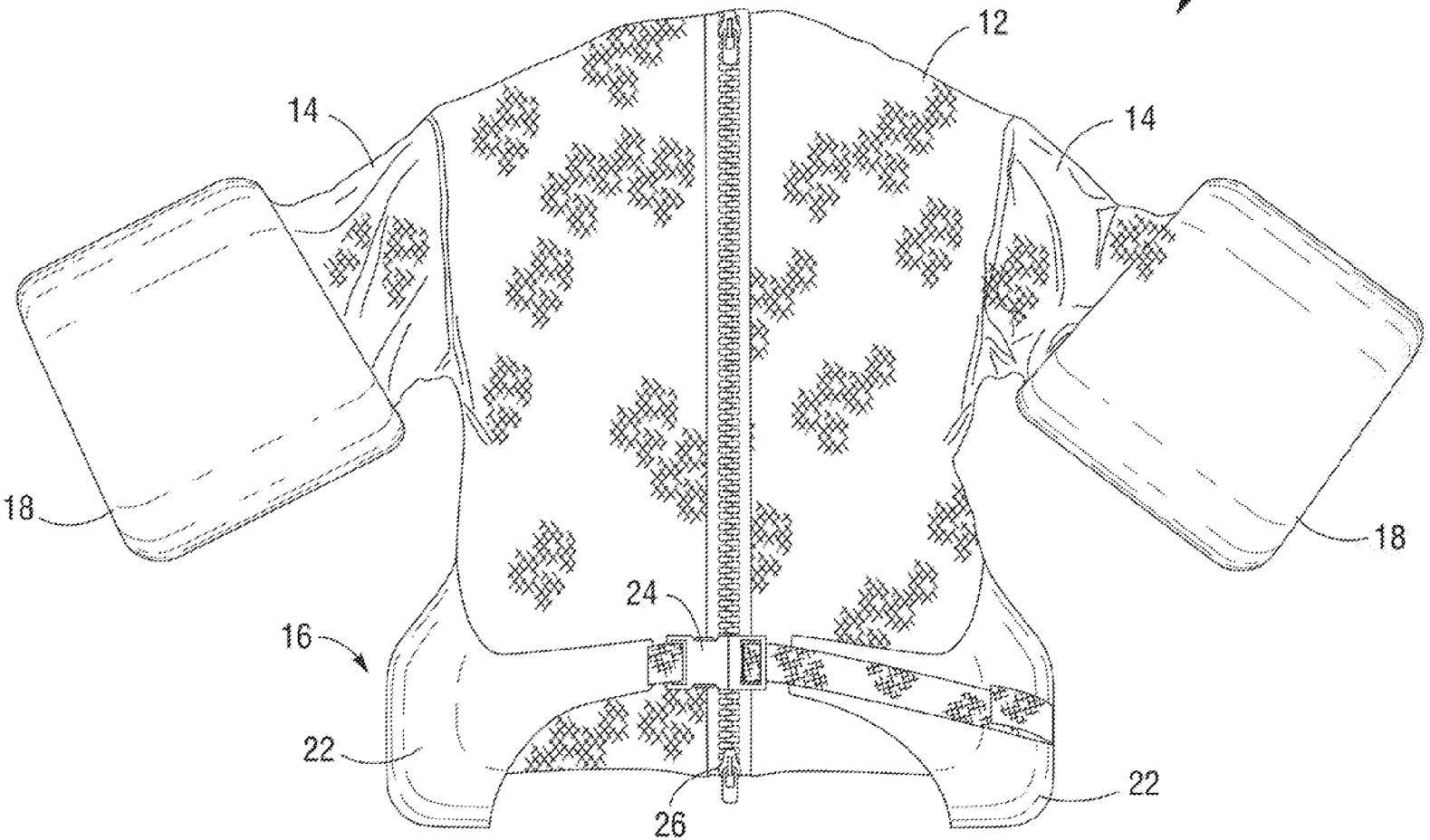
FIG. 2 provides a rear elevational view of the personal flotation device of FIG. 1.

The present invention resides in a personal flotation device that can be worn by a user. A front elevational view of a personal flotation device 10 in accordance with an embodiment of the present invention is shown in FIG. 1, and a rear elevational view of the personal flotation device 10 is shown in FIG. 2. The personal flotation device 10 includes a shirt 12 with sleeves 14. A torso flotation pad 16 is attached to the shirt 12 and is configured to wrap around the torso of a user. Two flotation sleeves 18 are attached to the sleeves 14, and wrap around the arms of the user. The personal flotation device 10 can be worn by a user by wearing the shirt 12 and then closing a zipper 26 in the back of the shirt.

In the depicted embodiment, the torso flotation pad 16 comprises an encased front flotation pad 20 and graduated side pads 22. The front flotation pad 20 comprises a flotation foam encased in fabric (e.g., neoprene, nylon, spandex, the synthetic fiber sold under the trademark Lycra, etc.) and sewn to the front of the shirt 12. The graduated side pads 22, also comprising encased flotation foams, are attached to the front flotation pad 20 and wrap around the user's torso to the user's back. The graduated side pads 22 are then buckled together in the back using a buckle 24. The size of the user may be accommodated by adjusting straps attached to the buckle 24.

Figure 3B:
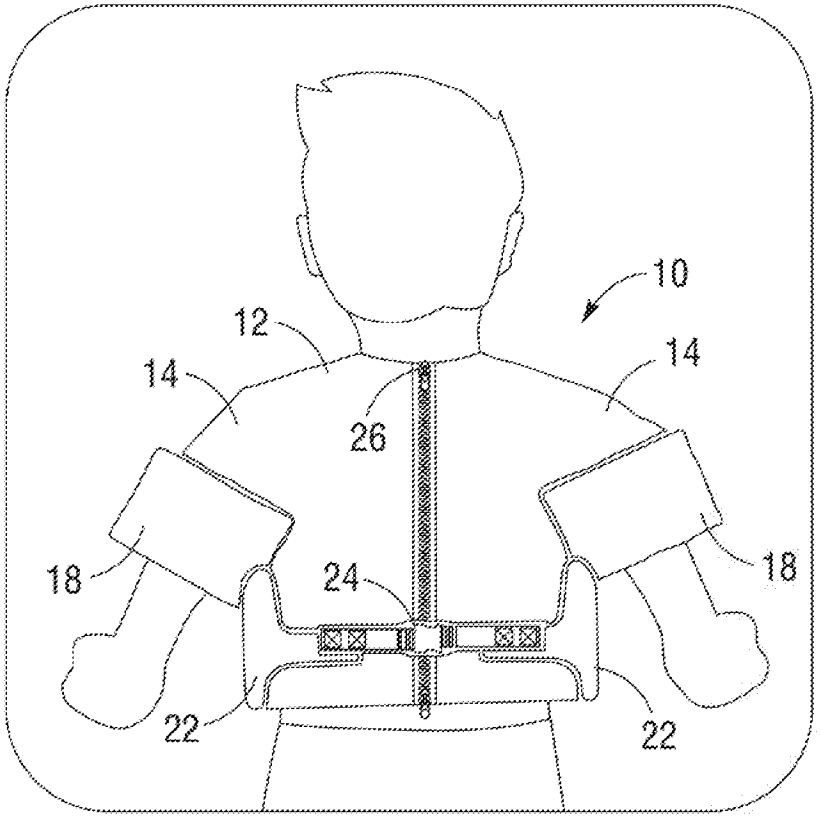
FIGS. 3A and 3B provide front and rear elevational views, respectively, of a user wearing the personal flotation device of FIGS. 1 and 2.
Figure 3A:
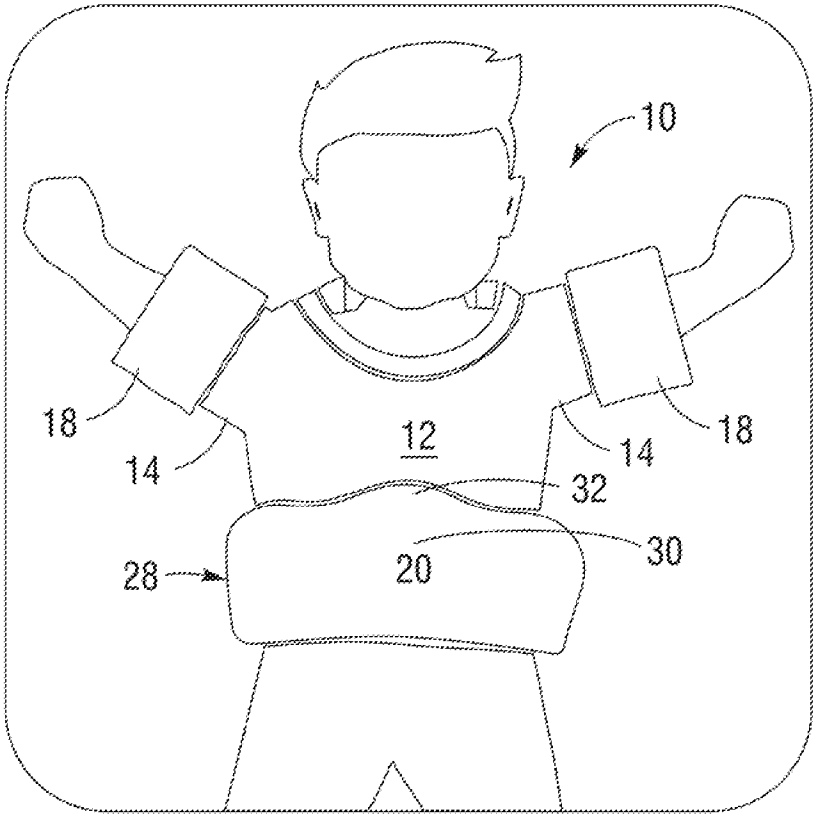

FIGS. 3A and 3B provide front and rear views, respectively, of a user wearing the personal flotation device 10 to demonstrate the placement of the different components of the personal flotation device 10 relative to a user's body.

The front flotation pad 20 is raised upward from the midriff (waist or stomach) area 28 to permit congruity between the wearer's center of gravity 30 and center of buoyancy 32. The raised foam placement permits the wearer to maintain a substantially perpendicular angle to the water, which encourages upright stability. Further, the raised front flotation pad 20 keeps the user's center of buoyancy at or above the user's center of gravity, which helps to keep the user's head above water and prevents the user from flipping over into the water.

The flotation sleeves 18 comprise buoyant foam encased in a fabric material (e.g., neoprene, nylon, spandex, the synthetic fiber sold under the trademark Lycra, etc.) that is sewn to the sleeves 14 and positioned on the upper portion of a wearer's arm. Through this placement of the flotation sleeves 18, the wearer's anatomical congruity raises the user higher out of the water, increasing the wearer's freeboard, i.e., the distance between the edges of the wearer's mouth to the water. Higher placement out of the water reduces the wearer's likelihood of ingesting water. This is particularly true when a user is performing a waving action, which might be used to indicate struggle or need for assistance, but can lead to a lowering of the user's body into the water and ingestion of water. The placement of the flotation sleeves 18 high on the wearer's arm increases the wearer's freeboard while simultaneously permitting freedom of movement in the water.

In more particular embodiments, the distance between the front flotation pad 20 and the flotation sleeves 18 may be from 2.5 to 8 inches. This distance comprises the distance from the top of the front flotation pad 20 to the shirt 12's arm hole, which may be from 2 to 6 inches, and the distance from the arm hole to the edge of the flotation sleeve 18, which may be from 0.5 to 2 inches.

The shirt 12 may be made of a stretch fabric such as spandex or the synthetic fiber sold under the trademark Lycra, which permits the wearer's anatomical shape to be accommodated by the fabric directly instead of having to rely upon the personal flotation device 10's adjustment means to secure the wearer. The stretch fabric may also provide an added benefit of providing sunburn protection for the wearer. In a preferred embodiment, the fabric provides sunburn protection of SPF 30 or above and, even more ideally, SPF 50 or higher.

The positioning of the zipper 26 and the buckle 24 on the wearer's back provides an added safety feature in that young children wearing the personal flotation device 10 cannot undo the buckle or the zipper. While a buckle 24 and a zipper 26 have been shown to secure the personal flotation device 10 on a user, it should be understood that any securing means may be used to accomplish this purpose. Numerous methods for securing a personal flotation device are known. Some examples include hook-and-loop fastener (e.g., Velcro), buttons, zippers, buckles, laces, hooks, magnets, and the like.

Although the invention has been disclosed with reference only to presently preferred embodiments, those of ordinary skill in the art will appreciate that various modifications can be made without departing from the invention. The specification and figures are, accordingly, to be regarded in an illustrative rather than a restrictive sense. As such, the present invention is defined only by the following claims and recited limitations.

The invention claimed is:

1. A personal flotation device comprising:

a shirt having two shirt sleeves;

a front flotation pad attached to the shirt and positioned in a torso area of the shirt; and at least two flotation sleeves, each flotation sleeve attached to one of the two shirt sleeves;

wherein the front flotation pad is raised upward above a midriff area of the shirt such that a wearer's center of buoyancy is positioned at or above the wearer's center of gravity when the personal flotation device is worn; and wherein the front flotation pad is separated from each of the at least two flotation sleeves by a distance.

2. The personal flotation device of claim 1, wherein the front flotation pad comprises a buoyant foam encased in a water-resistant fabric.

3. The personal flotation device of claim 1, wherein the at least two flotation sleeves each comprise a buoyant foam encased in a water-resistant fabric.

4. The personal flotation device of claim 1, wherein the shirt comprises a stretch fabric.

5. The personal flotation device of claim 4, wherein the shirt comprises a spandex fabric.

6. The personal flotation device of claim 1, wherein the at least two flotation sleeves are positioned on an upper arm area of the shirt.

7. The personal flotation device of claim 6, wherein the shirt comprises two armholes where the two shirt sleeves are attached to the shirt, each of the two armholes is separated from an associated one of the at least two flotation sleeves by a distance, and the distance from each armhole to the associated one of the flotation sleeves is from 0.5 to 2.0 inches.

8. The personal flotation device of claim 6, wherein the shirt comprises two armholes where the two shirt sleeves are attached to the shirt, the front flotation pad has a top edge that is separated from each of the two armholes by a distance, and the distance from the top edge of the front flotation pad to each of the armholes is from 2 to 6 inches.

9. The personal flotation device of 1, wherein the shirt further comprises securing means positioned on a back side of the shirt to secure the shirt around the wearer.

10. The personal flotation device of claim 9, wherein the securing means comprises a zipper.

11. The personal flotation device of claim 1, further comprising at least two side pads attached to opposite ends of the front flotation pad to wrap around the wearer's torso.

12. A personal flotation device comprising:

a shirt having two shirt sleeves, the shirt comprising a stretchable, water-resistant fabric;

a front flotation pad attached to the shirt and positioned on a torso area of the shirt;

two side flotation pads positioned on opposite sides of the front flotation pad and configured to be wrapped around a wearer's torso when the personal flotation device is worn; and at least two flotation sleeves, each flotation sleeve attached to one of the two shirt sleeves and positioned on an upper arm area of the shirt;

wherein the front flotation pad is raised upward above a midriff area of the shirt such that the wearer's center of buoyancy is positioned at or above the wearer's center of gravity when the personal flotation device is worn; and wherein the front flotation pad is separated from each of the at least two flotation sleeves by a distance.

13. The personal flotation device of claim 12, wherein the front flotation pad comprises a buoyant foam encased in a water-resistant fabric.

14. The personal flotation device of claim 12, wherein the at least two flotation sleeves each comprise a buoyant foam encased in a water-resistance fabric.

15. The personal flotation device of claim 12, wherein the shirt comprises a stretch fabric.

16. The personal flotation device of claim 15, wherein the shirt comprises a spandex fabric.

17. The personal flotation device of claim 12, wherein the shirt comprises two armholes where the two shirt sleeves are attached to the shirt, each of the two armholes is separated from an associated one of the at least two flotation sleeves by a distance, and the distance from each armhole to the associated one of the flotation sleeves is from 0.5 to 2.0 inches.

18. The personal flotation device of claim 12, wherein the shirt comprises two armholes where the two shirt sleeves are attached to the shirt, the front flotation pad has a top edge that is separated from each of the two armholes by a distance, and the distance from the top edge of the front flotation pad to each of the armholes is from 2 to 6 inches.

19. The personal flotation device of 12, wherein the shirt further comprises securing means positioned on a back side of the shirt to secure the shirt around the wearer.

20. The personal flotation device of claim 19, wherein the securing means comprises a zipper.

* * * * *